US009008971B2

(12) United States Patent
Keller

(10) Patent No.: US 9,008,971 B2
(45) Date of Patent: Apr. 14, 2015

(54) MEASUREMENT OF HYDRAULIC HEAD PROFILE IN GEOLOGIC MEDIA

(76) Inventor: Carl E. Keller, Santa Fe, NM (US)

( * ) Notice: Subject to any disclaimer, the term of this patent is extended or adjusted under 35 U.S.C. 154(b) by 622 days.

(21) Appl. No.: 13/374,440

(22) Filed: Dec. 29, 2011

(65) Prior Publication Data

US 2012/0173148 A1 Jul. 5, 2012

Related U.S. Application Data

(60) Provisional application No. 61/460,341, filed on Dec. 30, 2010.

(51) Int. Cl.

| | |
|---|---|
| ***G06F 19/00*** | (2011.01) |
| ***E21B 49/00*** | (2006.01) |
| ***E21B 47/10*** | (2012.01) |

(52) U.S. Cl.
CPC ..... *E21B 49/008* (2013.01); *E21B 47/10* (2013.01)

(58) Field of Classification Search
USPC ..... 73/152.41, 152.01; 702/2, 11
See application file for complete search history.

(56) References Cited

U.S. PATENT DOCUMENTS

| | | | | |
|---|---|---|---|---|
| 4,064,211 | A * | 12/1977 | Wood | 264/516 |
| 4,385,885 | A * | 5/1983 | Wood | 425/387.1 |
| 4,778,553 | A | 10/1988 | Wood | |
| 5,176,207 | A | 1/1993 | Keller | |
| 5,246,862 | A | 9/1993 | Grey et al. | |
| 5,377,754 | A | 1/1995 | Keller | |
| 5,803,666 | A | 9/1998 | Keller | |
| 5,804,743 | A | 9/1998 | Vroblesky et al. | |
| 5,853,049 | A | 12/1998 | Keller | |
| 6,026,900 | A | 2/2000 | Keller | |
| 6,109,828 | A | 8/2000 | Keller | |
| 6,244,846 | B1 | 6/2001 | Keller | |
| 6,283,209 | B1 | 9/2001 | Keller | |
| 6,286,603 | B1 * | 9/2001 | Parent | 166/387 |
| 6,761,062 | B2 * | 7/2004 | Shapiro | 73/152.41 |
| 6,910,374 | B2 * | 6/2005 | Keller | 73/152.41 |
| 7,281,422 | B2 * | 10/2007 | Keller | 73/152.41 |
| 7,753,120 | B2 | 7/2010 | Keller | |
| 7,841,405 | B2 | 11/2010 | Keller | |
| 7,896,578 | B2 | 3/2011 | Keller | |
| 8,069,715 | B2 | 12/2011 | Keller | |

(Continued)

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.

(Continued)

*Primary Examiner* — Jonathan C Teixeira Moffat
*Assistant Examiner* — Peter Ngo
(74) *Attorney, Agent, or Firm* — Rod D. Baker

(57) ABSTRACT

A system for measuring a profile of a hydraulic head. A flexible liner is everted down the borehole. The profile of the transmissivity of the geologic media is obtained during (and indirectly from) the eversion of the flexible liner as it proceeds down the borehole. The liner is then retrieved by inversion from the borehole, while the pressure head in the borehole fluid below the liner is monitored and measured. From the previously obtained transmissivity profile, and the measured head within the borehole, the hydraulic head in the geologic media surrounding the borehole is determined for borehole intervals. A complete hydraulic head profile may be obtained from the collected data.

9 Claims, 6 Drawing Sheets

(56) References Cited

U.S. PATENT DOCUMENTS

| | | | | |
|---|---|---|---|---|
| 8,176,977 | B2 | 5/2012 | Keller | |
| 8,424,377 | B2 | 4/2013 | Keller | |
| 2009/0139321 | A1* | 6/2009 | Flaum | 73/152.51 |
| 2012/0125641 | A1* | 5/2012 | Barrash et al. | 166/387 |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

MEASUREMENT OF HYDRAULIC HEAD PROFILE IN GEOLOGIC MEDIA

CROSS-REFERENCE TO RELATED APPLICATIONS

This application claims priority to U.S. Provisional Application Ser. No. 61/460,341, entitled "Measurement of Hydraulic Head Profile in Geologic Media" filed on 30 Dec. 2010, the entire disclosure of which is incorporated herein by reference.

BACKGROUND OF THE INVENTION

1. Field of the Invention

This invention relates to the measurement of the discrete hydraulic head in aquifers within geologic media adjacent to a borehole, in conjunction with transmissivity data previously measured for the same medium.

2. Background Art

A "borehole" is a hole, e.g., a drilled shaft, into the Earth's subsurface. The hydraulic conductivity profiling techniques described in my U.S. Pat. Nos. 6,910,374 and 7,281,422 have been used in over 200 boreholes since 2007. These two patents, whose complete teachings are hereby incorporated by reference, describe the hydraulic transmissivity profiling technique which carefully measures the eversion of a flexible borehole liner into an open stable borehole. From those measurements is obtained a monotonically decreasing liner velocity, from which is calculated a continuous transmissivity distribution in the geologic formation penetrated by the borehole. The method of these patents assumes a constant head distribution in the formation if no other information is available. The flow in the geologic formation, however, is dependent not only on the transmissivity but also on the head in the formation. In particular, the vertical transport of contaminants and the recharge of subsurface aquifers depend upon the definition of the vertical transmissivity and the vertical gradient. The definition of aquitards is particularly important to the understanding of the migration of ground water contaminants.

With the foregoing background, the presently disclosed invention was developed. The invention described hereafter helps to determine and define the presence of aquitards, and to assist in the definition of those intervals which may then be best monitored with a multi-level sampling system for water quality and long term vertical gradient definition.

SUMMARY OF THE INVENTION

There is disclosed a method, using a flexible everting/inverting borehole liner, of measuring hydraulic head and determining the distribution of hydraulic head in subsurface geologic formations. The method uses the unique properties of a flexible borehole liner to obtain a measurement of the integrated head beneath the liner. This head measurement is performed, on any preferred spatial scale, while the liner is inverted from the borehole. Using the transmissivity profile information obtained during the eversion of the liner into the borehole, it is possible to calculate the hydraulic head in the geologic formation adjacent to each incremental interval of borehole wall as the liner is withdrawn from each increment. In one embodiment, the liner inversion from the borehole is done in a stepwise manner, with a pause after each interval is exposed. During the paused inversion, the tension on the inverted end of the liner is measured to obtain the pressure (head) in the borehole in the open hole volume below the everting/inverting bottom end of the liner. An optional alternative method uses a pressure transducer below the bottom end the liner to obtain the borehole pressure history directly, rather than indirectly from incremental tether tension measurements. Using coupled flow equations for those borehole intervals which have been exposed by the inverting liner, the hydraulic head can be calculated for each newly exposed layer of the formation corresponding to the exposed interval.

BRIEF DESCRIPTION OF THE DRAWINGS

The attached drawings, which form part of this disclosure, are as follows.

Figure 1:
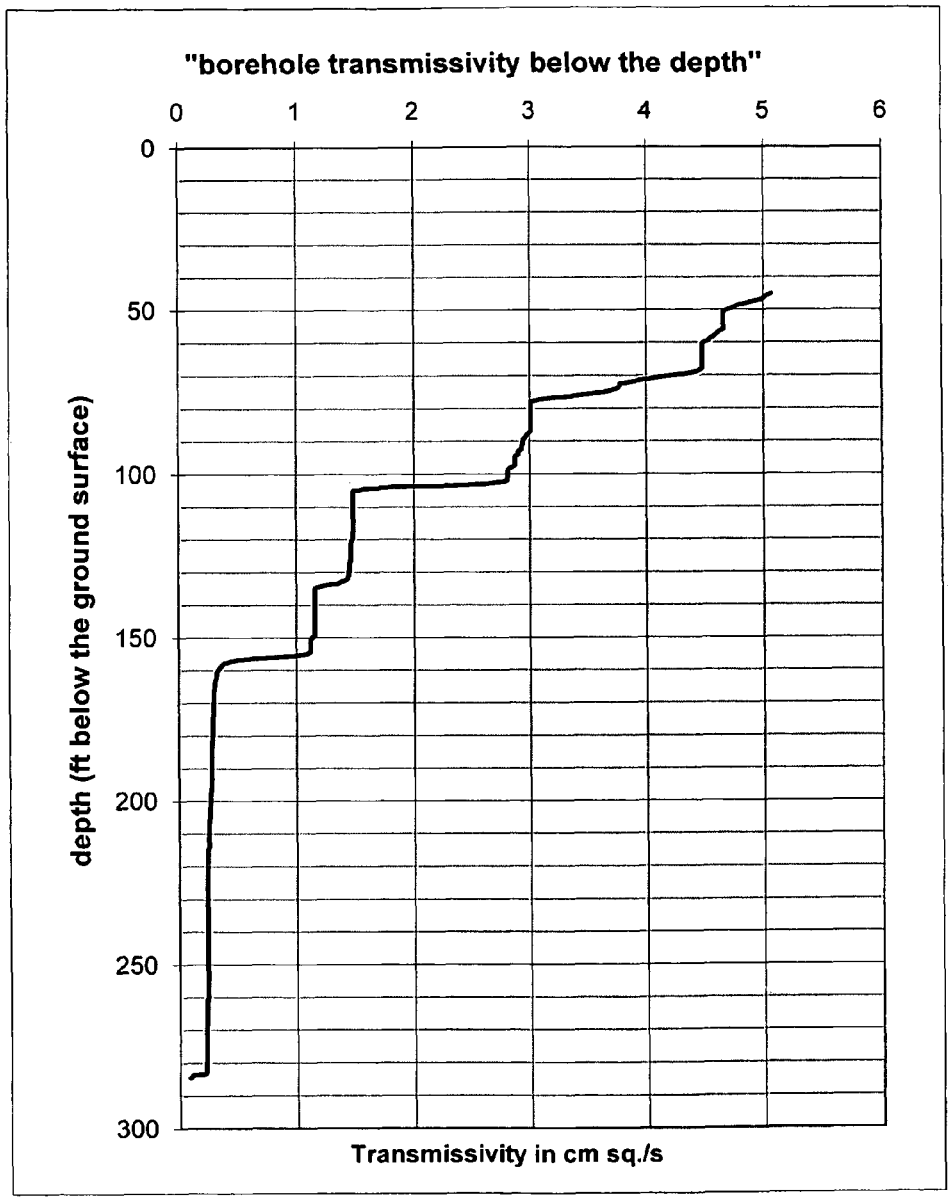
FIG. 1 is a plot of a transmissivity profile obtained during the eversion of a flexible borehole liner.

DESCRIPTION OF THE INVENTION, (INCLUDING THE BEST MODE FOR PRACTICING THE INVENTION)

This is a disclosure of a method and system for profiling the hydraulic head in the geologic media around a borehole. Borehole hydraulic head profile information is useful in a variety of subsurface geologic activities, explorations, and remediation.

According to the presently disclosed method, hydraulic head information pertaining to the media of formations along the borehole is derived from hydraulic transmissivity data and borehole head pressure data obtained for a successive series of intervals along the borehole depth. The intervals may be arbitrary, or in the practice of the invention may be correlated with discrete geological layers or strata, with layer/stratification data may have been previously obtained from borehole drilling logs and/or transmissivity data.

The present system and method involves the eversion and inversion of a flexible liner down and up the borehole. General techniques for borehole liner eversion and inversion are known in the art. In the process of liner eversion, the collapsed liner typically is paid out from a rotating reel, and preferably is passed over a guide roller. The free end of the liner is fastened and sealed to the proximate end of the borehole's casing. The liner is then progressively filled with driving fluid, usually water, introduced via an above-ground fluid conduit. The fluid is poured into contact with the "outside" surface of the liner, but as a result of the pressure of fluid pushing the liner down the borehole, the collapsed tube of the liner is pressed against the walls of the borehole, resulting in the eversion of the liner. The actual eversion of the liner occurs at a constantly moving "eversion point" as an ever greater length of the liner fills with driving fluid. At the eversion point, the former "outside" surface of the liner effectively becomes the inside surface, as the water or other fluid introduced from the surface fluid conduit inflates and fills the liner thereby to press the former "inside" surface of the liner securely against the wall of the borehole, as suggested in drawing FIG. 2. It is contemplated that the liner is manufactured and disposed upon the reel "inside out," so that the liner surface that eventually contacts the borehole wall initially defines the interior of the collapsed liner. As the borehole fills with driving fluid, the driving fluid nevertheless is continually contained within the inflated liner, which impermeably lines the borehole above the downwardly moving eversion point. The liner thus is passed along the borehole, with the liner's eversion point—where the liner doubles back against itself—moving at some velocity.

When the closed distal or "absolute" end of the liner is withdrawn from the borehole (as by a tether attached thereto and extending up the borehole to the surface), the liner is retracted from the borehole. When the liner is being retracted, the liner strictly speaking is not everting but rather is "inverting" at an upwardly moving inversion point.

The U.S. Pat. No. 6,910,374 entitled "Borehole Conductivity Profiler" describes my previous method for obtaining a continuous transmissivity profile of a geologic formation penetrated by a borehole, using an everting flexible borehole liner. The entire disclosure of U.S. Pat. No. 6,910,374 is incorporated herein by reference. The liner is placed into the borehole by "eversion" (turning the liner "inside-out") down the borehole; the liner is retracted or withdrawn from the borehole by inversion (reversing the liner topology to restore it to its pre-eversion configuration).

The first step of the instant method is to obtain the transmissivity profile of the particular borehole of interest. This very preferably is done by the methodology of U.S. Pat. No. 6,910,374. There is described therein a method for using a flexible everting borehole liner to perform fluid conductivity measurements in geologic media surrounding and substantially adjacent a borehole below the surface of the Earth. In summary, a flexible liner is everted down the borehole with an internal pressurized fluid. As the liner displaces ambient fluid from the borehole and into the surrounding geologic formations, the rate of descent of the liner is monitored and recorded. As the impermeable liner progressively covers the flow paths in the wall of the borehole, the descent rate slows. From the measured descent rate, the flow rates out of discrete intervals of the borehole are determined.

By this method of everting down-hole a water-impermeable liner, the users determine the hydraulic transmissivity of material surrounding the borehole. Succinctly characterized, the process involves sealably fastening an upper end of a flexible liner to a top end of the borehole (e.g. borehole surface casing), everting a flexible liner down the borehole by moving a liner eversion point down the borehole to cover successively a plurality of borehole intervals, measuring the velocity of the moving eversion point, calculating from the velocity of the eversion point the conductivity of the media subtending each borehole interval, and using the media conductivity to calculate the transmissivity of the media subtending each borehole interval.

The process step of calculating conductivity may include the step of determining a gross fluid flow rate outward into the surrounding media from the open hole volume portion of the hole beyond (i.e. below) the everting bottom end of the liner. The method may also include the further step of monitoring for changes in velocity of the eversion point, when the liner covers a flow path into a surrounding material, as the gross fluid flow rate out is reduced by the amount of flow in the flow path covered, concurrently causing a change in the eversion point's velocity. The eversion point's velocity versus borehole depth can then be plotted to locate changes in conductivity associated with changes in eversion point velocity. Additional details may be had by reference to U.S. Pat. No. 6,910,374. Transmissivity of an interval of borehole length may be readily calculated from the conductivity of the surrounding media along that interval according to known hydrogeologic principles.

Another fundamental step in the process and system of the present invention is the determination of the pressure head in an open hole volume within the borehole between the liner's eversion/inversion point and the bottom of the borehole. This may be accomplished, in one embodiment of the process, by controllably manipulating the elevation of a liner inversion point within the borehole. This manipulation preferably is accomplished by means of a tether attached between the closed absolute end of the liner and some feature at the surface above the top end of the borehole. The tether is securely attached to the closed absolute end of the liner, and also at its other, upper, end is in operative attachment with some suitable means for monitoring/measuring the tension in the tether. The tether typically is under tension due to the tether's supporting the liner's distal closed end within the borehole while the interior of the liner is filled with the driving fluid (typically water). By controllably raising and lowering (with the tether) the inversion point of the liner, and monitoring and recording changes in the tension in the liner (liner tension), the borehole pressure head in the open hole volume below the inversion point can be calculated using known equations from the field of hydrogeology.

Alternatively, the borehole pressure head in the open hole volume between the liner's inversion point and the bottom of the borehole can be monitored and measured directly with a pressure transducer disposed at or near the borehole's bottom. A pressure transducer below the liner makes the measurement easier, but introduces a concern about the presence of a transducer signal cable running the depth of the borehole, outside the liner and next to the borehole wall, and the associated potential leakage of borehole fluids along the cable. The use of the tether tension monitoring method eliminates this leakage risk.

Attention is invited to FIG. 1, graphically depicting a transmissivity profile obtained for a typical borehole through the everting of a liner into the borehole by the apparatus and method of U.S. Pat. No. 6,910,374. The transmissivity of the geologic media around the borehole is plotted as a function of the depth below ground surface. FIG. 1 is by way of illustrative example; each borehole of interest will manifest its own unique transmissivity profile.

Figure 2:
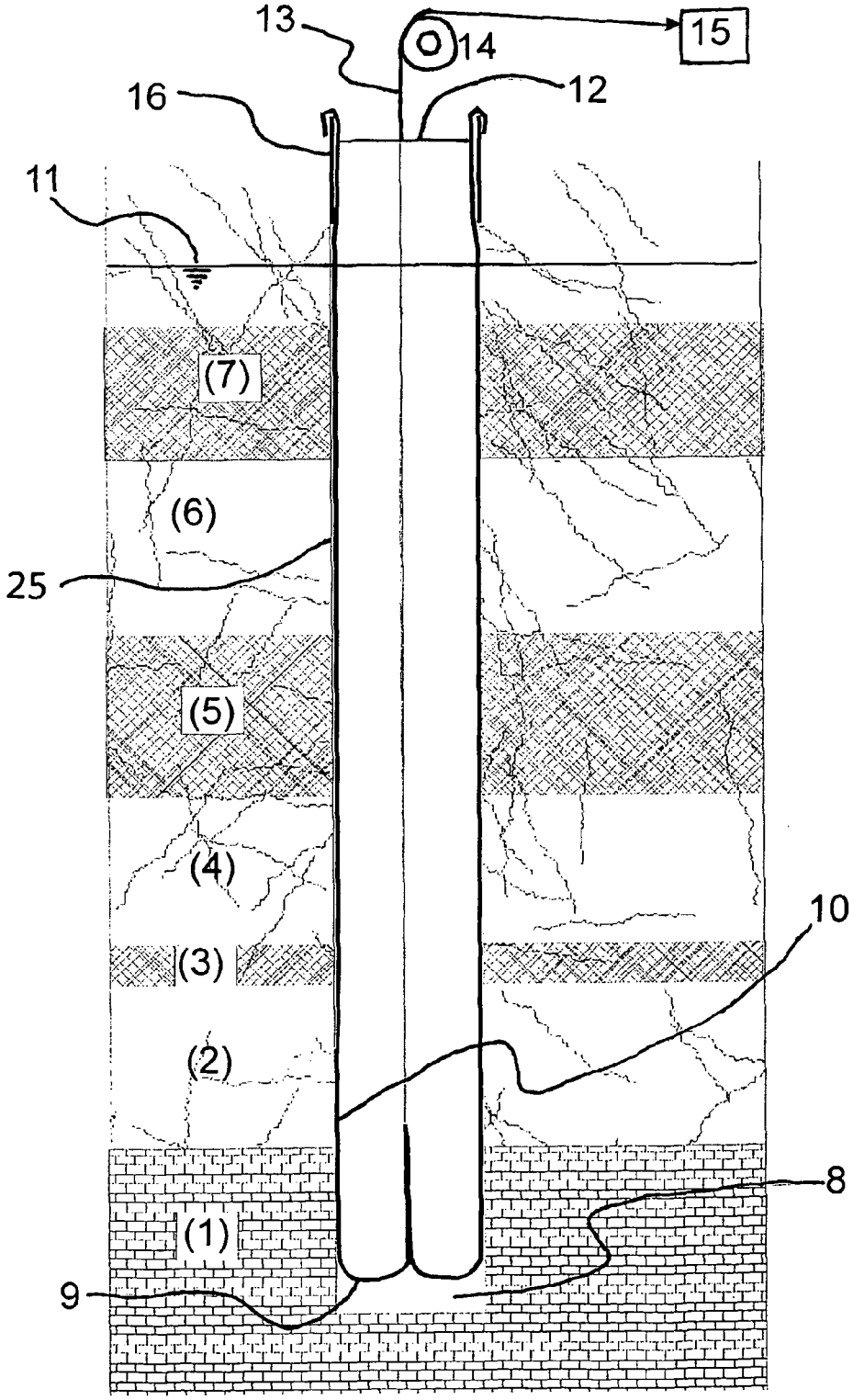
FIG. 2 is a side sectional diagram of a flexible liner that is sealing a borehole after the transmissivity profile has been determined.

When the transmissivity measurement is terminated, the everted liner usually has not reached the absolute bottom of the borehole, due to the low transmissivity of the lower portion of the hole's wall, and the resulting very slow descent of the liner into the bottom-most portion of the borehole. Thus FIG. 2 shows in vertical section a borehole 25, and the liner 10 emplaced by eversion therein, in a layered geologic medium composed of geologic media layers 1-7. A tether 13, such as a strong cord or cable, is attached to the absolute (closed) end of the liner 10, and is used to support the closed end of the liner within the borehole, and to draw that closed end toward the surface, that is, to "invert" the liner to retract it from the borehole 25. The open upper end of the liner 10 is secured to the surface casing 16 as known in this art. The tether 13 typically is passed over a roller 14 at the surface to redirect the tether 13 to a suitable means 15 for controlled application of a measured tension to the tether. The roller 14 is equipped with an encoder and recording device which records the roller rotation, and hence the distance and/or speed of tether travel up or down in the borehole 25. A pressure transducer, submerged in the water filling the liner 10 to a level 12, is used to measure the interior pressure head of the liner and therefore the water level 12 inside the liner.

After the completion of the transmissivity measurement in the borehole 25, the liner 10 has been installed to be positioned as shown in FIG. 2. The pressure head inside the liner (per water level 12) is greater than the head in the adjacent geologic formation by the amount of the level difference between the water table 11 in the geologic formation and the level 12 within the liner. The liner 10, having a higher internal pressure than the head in the formation, is forced against the borehole wall for that length of the liner above the eversion point of the liner. The liner 10 thereby provides a seal of the entire borehole against flow between the liner 10 and the borehole wall, and thus prevents through-flow into or out of the borehole—except below the liner in the interval defining an open hole volume 8 between the absolute bottom of the borehole 25 and a lowermost eversion/inversion point (i.e. bottom end 9) of the liner 10.

It is noted here that the present method requires the availability of a unique, and substantially continuous, transmissivity profile corresponding to and for the particular borehole. While transmissivity in principal can be obtained with packer tests, the time to do so would be in place of the transmissivity profile, much more time consuming and with lower definition. The use of packers takes much longer and depends upon (the comparatively unreliable) seal quality for the packer. Thus, the unique capability of the everted liner 10, as seen in FIG. 2, to seal the entire borehole 25 above the open hole volume 8 is a major advantage to the present measurement method, as it prevents any bypass of the seal at the top of the open hole volume 8 as would be the case for conventional packer emplacement.

The invention optionally but preferably includes the process whereby borehole pressure below the liner is determined by the manipulation, via the tether 13 of the elevation of the liner eversion point. By way of summary introduction, this step of determining a borehole pressure head comprises using the tether 13, as disposed between a closed absolute end of the liner and the surface above the top end of the borehole 25. The liner pressure head (HL) within the interior of the liner is monitored, generally continually throughout the step. The tether 13 is lifted a distance along an interval of the borehole 25, thereby inverting the liner 10 to establish a first elevation for the inversion point of the liner, where the inversion of the liner is halted. The tether tension (T) decreases as water flows from geologic media subtending this first borehole interval and into the open hole volume between the inversion point and a bottom of the borehole; the decreasing tether tension is monitored until the tether tension stops decreasing and stabilizes at a first equilibrium tension value $T_{in}$, which first equilibrium tension value is then recorded. (Tether tension monitoring and recording, as with most monitoring and measuring processes, may be assisted by any suitable computer adjunct.) The tether 13 is then briefly lowered to allow the liner 10 to evert a distance back down the borehole 25, but within the same first borehole interval, to establish a second elevation for the inversion point of the liner, where the liner eversion is then halted. The tether tension then increases as water in the open hole volume between the liner inversion point and the bottom of the borehole is forced from the open hole volume between the inversion point and a bottom of the borehole and back into media subtending this first borehole interval; tether tension is monitored until it stops increasing and stabilizes at a second equilibrium tension value ($T_{ev}$), which second equilibrium tension value is then recorded.

Thereafter the first and second equilibrium tension values are used, as described herein below, to calculate a differential pressure across the liner 10 at the liner inversion point. The borehole pressure head (BH) can then be calculated from the liner pressure head and the differential pressure, also as explained further herein. The foregoing step can be successively repeated over and for a series of borehole intervals to compile borehole pressure head data for each selected interval.

Referring to FIG. 2, the unsealed open hole volume 8 is in communication with the pore pressure of the lowest geologic layer 1, and in equilibrium with the formation head in the lowest media layer 1. Layer 1 is a geologic stratum identified in FIG. 1, in this example having a higher transmissivity than other portions of the formation, as measured by the method of U.S. Pat. No. 6,910,374. The tension on the tether 13 is caused by a difference between the pressure head inside the liner 10 and the pressure head below the liner in the open hole volume 8. That differential pressure develops a force against the bottom end 9 of the liner 10 that is counteracted by the tension in the tether 13 to prevent the liner from everting further down the hole (when, as is often the case, the head in open hole volume 8 is less than the head inside the liner resulting from water level 12). It is important to the practice of the present method that the liner head (from level 12) inside the liner 10 always be higher than the head below the liner in the open hole volume 8. This is ordinarily the condition, but can be induced by user-controlled adjustment of the liner water level 12 to a sufficiently high elevation inside the liner 10. However, for artesian conditions where the head (level 12) is less inside the liner 10, a device in other embodiments described hereinafter can be used to maintain that necessary condition.

The means 15 for measuring the tension in the tether 13 can be any suitable tension gauging device known in the art. Measuring tension in the tether allows a determination of the differential pressure between the interior liner head and the head in the open hole volume 8. Measurement of the tether tension at means 15 for a wide variety of liner materials and driving pressures inside the liner 10 has allowed the determination of a relatively constant relationship between the tether tension T and the differential pressure across the inversion point (e.g. bottom end 9 as seen in FIG. 2) of the liner. That relationship is:

$$T_{ev}=\tfrac{1}{2}(DP-P_{min})A$$

(tension $T_{ev}$ during the eversion of the liner), and $$T_{in}=\tfrac{1}{2}(DP+P_{min})A$$

(tension $T_{in}$ during the inversion of the liner), where DP is the differential pressure across the liner at its bottom end eversion/inversion point, A is the horizontal cross sectional area of the hole at the location of the liner bottom end, and $P_{min}$ is the minimum pressure that will cause further eversion of the liner. If the liner 10 is very long and the inverted liner and tether 13 are in contact with the borehole wall (e.g., in a crooked hole), then there is an additional drag term in the equations for T:

$$T_{ev}=\tfrac{1}{2}(DP-P_{min})A-\text{Drag}$$

and $$T_{in}=\tfrac{1}{2}(DP+P_{min})A+\text{Drag}$$

Drag is the frictional force of the inverted liner 10 and the tether 13 dragging on the borehole wall. In the geometry of FIG. 2, neither $P_{min}$ nor the Drag is well known, although experience in the art permits reasonable estimates to be made.

However, it is not necessary that either the Drag or $P_{min}$ be known for the head profiling method according to this disclosure.

According to the present method, borehole pressure head in the open hole volume 8 below the liner is obtained by inverting the liner 10 up the borehole by repeatedly moving the liner's inversion point incrementally up the borehole to uncover a first one (and preferably then a series) of borehole intervals. The borehole pressure head in the first (and subsequent) open hole volume 8 between the inversion point and a bottom of the borehole is determined, and then the formation pressure head in the first (and then subsequent) borehole intervals is calculated from the borehole pressure head in the first (and subsequent) open hole volumes and from the transmissivity of the media subtending the first (and corresponding subsequent) borehole interval.

The incremental process is repeated step-wise; thus, the liner inversion point is moved incrementally up the borehole to uncover successively a second one of the borehole intervals, a second borehole pressure head is determined in a second open hole volume between the inversion point and the bottom of the borehole, and the formation pressure head in the media subtending the second borehole interval is calculated from the second borehole pressure head in the second open hole volume and from the transmissivity of the media subtending the second borehole interval.

Figure 3:
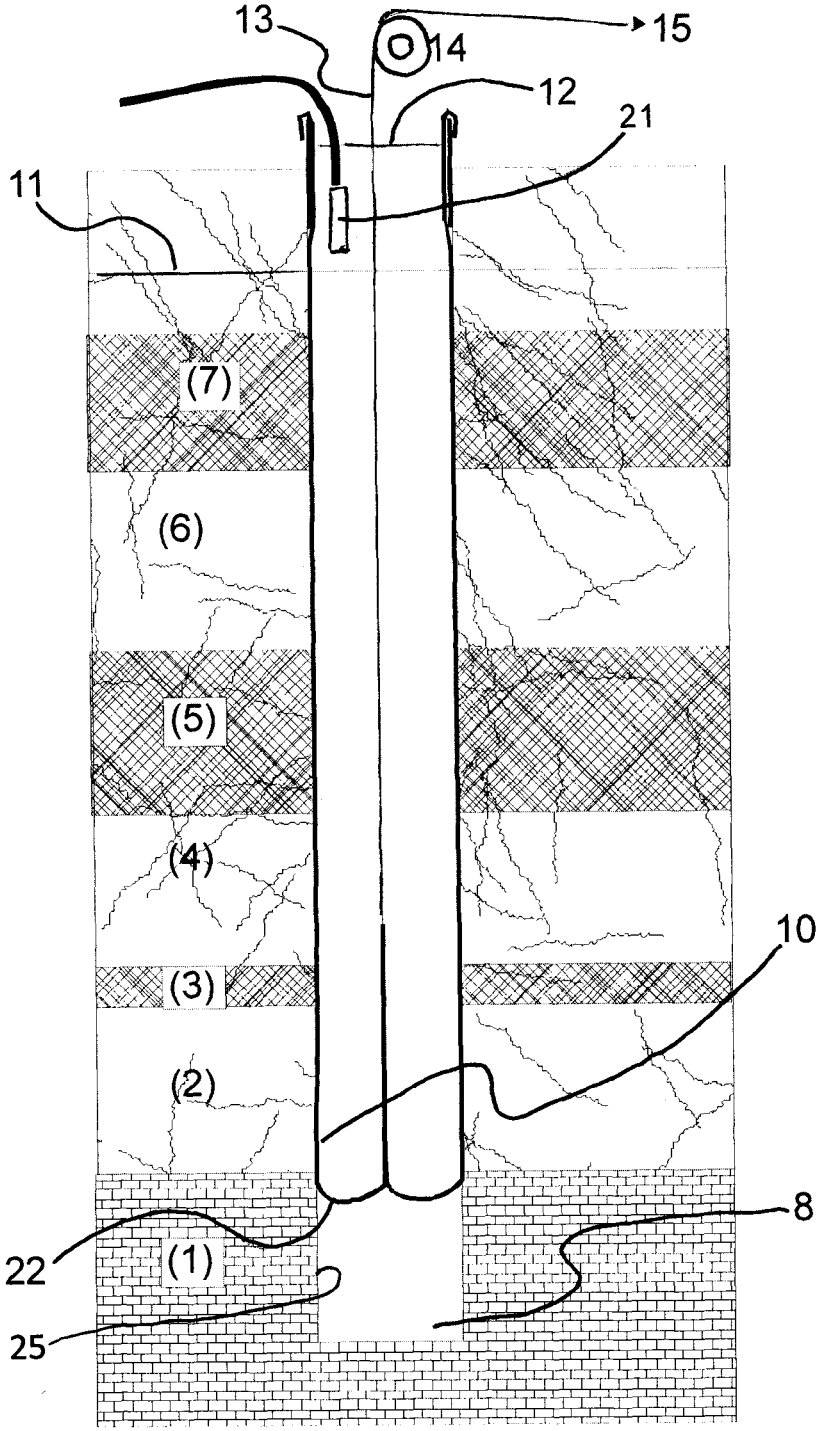
FIG. 3 is a side sectional diagram of the geometry of the liner after it has been incrementally inverted to uncover a first interval of the borehole.

In the geometry of FIG. 3, the tether 13 has been lifted a short distance, to establish a new elevation for the new bottom end inversion point 22 of the liner, by increasing the force applied to the tether at, e.g., means 15. The tether 13 preferably, but not necessarily, is retracted to place the new elevation of the inversion point 22 of the liner preferably in the vicinity of the demarcation between first geological layer 1 and second geologic layer 2. The tension required to cause this resulting inversion of the liner 10 back up the borehole, and the raising of the inversion point to its higher level, is measured at means 15. The pump 21 is used to remove the water in the liner 10 as the liner is inverted back up the borehole, so as to maintain a constant head in the liner (a convenient condition, but not absolutely required). In some cases, the water level 12 is at the top of the surface casing, and the water simply overflows to maintain the same liner interior head.

After the liner is thus inverted a distance, the inversion of the liner 10 then is halted. The tether tension is monitored as water flows into the open hole volume 8 from first geologic layer 1 in the formation, and the head in the volume 8 rises, causing the differential pressure DP to decrease until the system is in equilibrium. Until equilibrium is achieved, the tension is monitored and recorded at means 15 until it is no longer decaying (decreasing) and has stabilized at a first equilibrium tension value $T_{in}$. The force applied to the tether (e.g., at means 15) is then briefly reduced, thus briefly lowering the tether and allowing the liner 10 to evert a short distance back down into the borehole 25. When this brief liner eversion descent is halted, the tether tension rises as the water in the open hole volume 8 is forced back into the first formation layer 1. After the monitored tether tension rises to an equilibrium tension $T_{ev}$, and this second equilibrium tension value is recorded. The two measured equilibrium tension values are added:

$$T_{in}+T_{ev}=\tfrac{1}{2}A(DP+P_{min})+\text{Drag}+\tfrac{1}{2}A(DP-P_{min})-\text{Drag}$$

and thus $$T_{in}+T_{ev}=A(DP)$$

Adding $T_{ev}$ to $T_{in}$ causes both $P_{min}$ and Drag to be cancelled, since they have opposite signs in the two equations. The sum is equal to the product of DP and A, allowing DP to be derived from the sum of the measured equilibrium tension values. Value A is the cross-sectional area of the borehole at the elevation of the liner bottom end at the new inversion point 22. Such area may be determined from the bit size used to drill the borehole, or is actually measured by a caliper log obtained from running a caliper sonde in the borehole after it was drilled. The latter caliper measurement is preferred over the estimate from the drill bit used.

From the sum of the two measure tensions, the differential pressure is determined with good accuracy. Since the value of A is known, DP can thus be determined from the two equilibrium tension measurements for a small oscillation in the liner elevation at the new inversion point 22. However, in FIG. 3 the value of DP is just the difference between the known head (from liner water level 12) and the head in the open hole volume 8, thus the head in volume 8 is:

$$BH=HL-DP$$

where BH is the head in the open borehole below the inversion point 22 of the liner, HL is the measured head within the liner interior (e.g., per head level 12) and DP is the differential pressure as determined above. The net result of the above procedure is the determination of the borehole head in open hole volume 8. In the particular geometry of FIG. 3, BH is the formation head ($FH_1$) in the formation layer 1, due to of the flow connection between the first formation layer 1 and the open hole volume 8. In this manner, the formation head $FH_1$ in formation layer 1 is determined.

Now to be described is the procedure for measurement of the formation head in the next upper formation layer, geologic formation layer 2. An object of the present method is to measure the head in each borehole interval of interest (e.g., corresponding more or less to any one or more of the geologic formation layers 1 through 7 in FIGS. 2-4) in the surrounding geologic media as desired. Measurements from a series of intervals allows the derivation of a formation head profile along the depth of the borehole.

Figure 4:
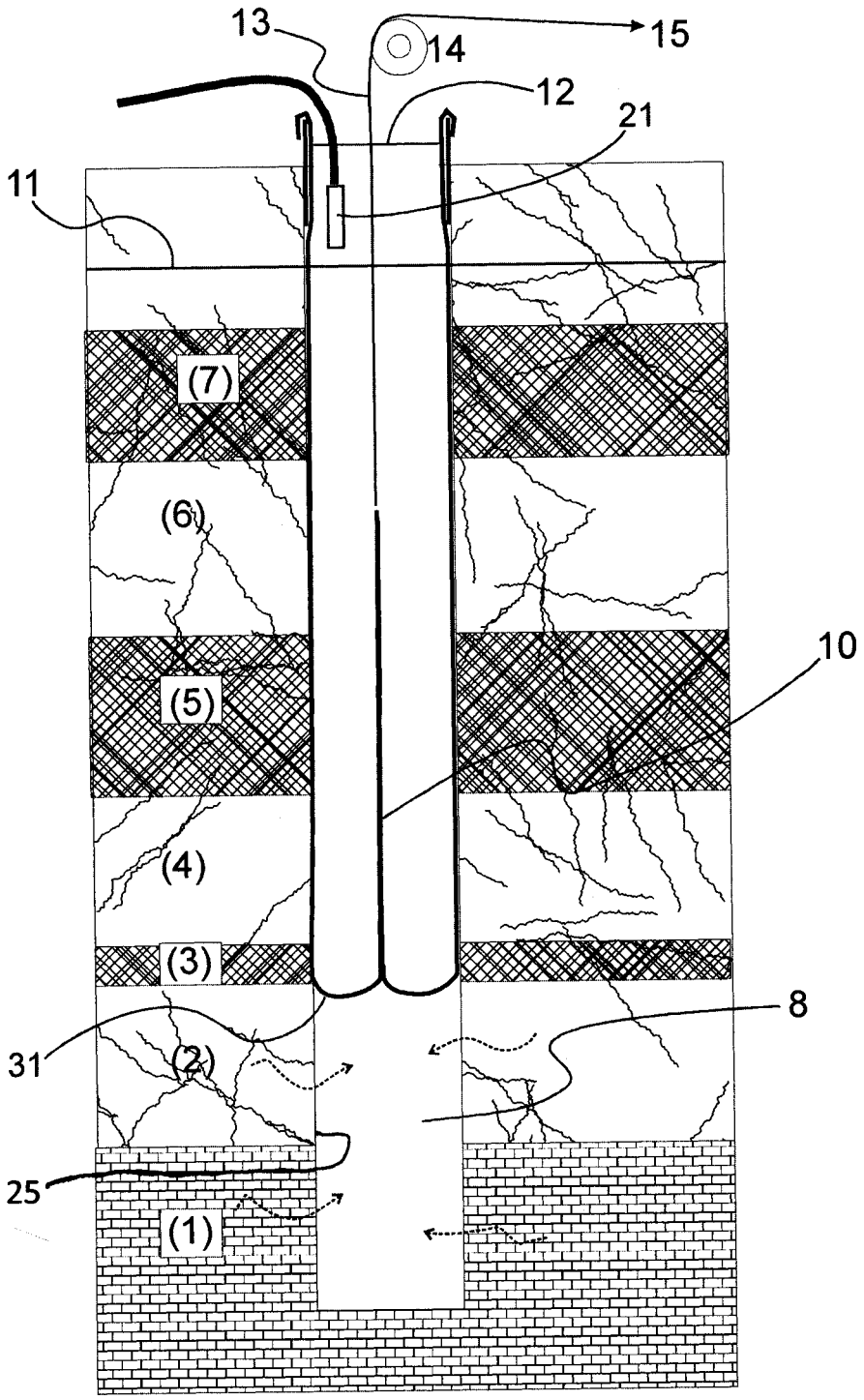
FIG. 4 is a side sectional diagram of the geometry of the liner after it has been incrementally inverted to uncover a second interval of the borehole.

FIG. 4 shows a subsequent geometry of the liner 10 in the borehole after the tether tension at means 15 is again increased to cause the liner to invert to uncover the borehole interval subtended by the formation layer 2. In this new configuration, the procedure described hereinabove is repeated at the yet higher elevation of the second "new" bottom end inversion point 31 of the liner. The inversion of the bottom of the liner to the level of inversion point 31 is halted (for example at the demarcation between geologic layer 2 and layer 3), and the equilibrium inversion tension is measured at means 15 after the flows equilibrate into or out of the open hole volume 8 of the borehole. The tether's applied supporting force at 15 is then briefly reduced, again to permit a short descent of the inversion point 31 of the liner 10. After the tension is monitored till it has stabilized, the equilibrium tension is (again) measured at means 15. These two equilibrium tensions are added to obtain the differential pressure $DP_2$ for the new position of the liner associated with this third new liner inversion point 31 elevation.

Because, in FIG. 4, the new interval of the borehole (between inversion points (22) and (31) of the bottom end of the liner 10) has been exposed, flow can occur into, or out, of the second formation layer 2. The new borehole head, $BH_2$, in the volume between the very bottom of the borehole 25 and the inversion point 31 of the liner 10, is determined as above (i.e., $BH_2=HL-DP_2$) from $DP_2$. This subsequent borehole head $BH_2$ may cause flow also to occur into or out of the first formation layer 1. For steady state flow (Q) into or out of a borehole, hydrologists use the Thiem equation:

$$Q=KH(DP)2\pi/\ln(R)$$

where K is the hydraulic conductivity of the borehole interval H, DP is the head difference, and R is the ratio of the borehole radius to the radius in the formation where the head is at the natural value FH, i.e. the ambient head. Using the extended Thiem equation for both formation layers 1 and 2, one can calculate the flow into or out of the borehole, in the system configuration of FIG. 4 and under the condition of the borehole pressure $BH_2$, thus:

$$Q=(K_1H_1(BH_2-FH_1)+K_2H_2(BH_2-FH_2))(2\pi/\ln(R))$$

where $K_1$ is the conductivity of the first formation 1, $H_1$ is the borehole interval uncovered when $M_1$ was measured, $M_1$ is the formation pressure in formation layer 1 (which is also $BH_1$), $K_2$ is the conductivity of the interval uncovered by the inversion of the liner to expose the second formation layer 2, $BH_2$ is the "new" measured borehole pressure described above, and $FH_2$ is the formation head in the second layer 2. The value of $FH_2$, of course, is sought and to be calculated.

In general, the product of K and H for a borehole interval is the transmissivity, T, of that interval of length H. From FIG. 1, which graphs the transmissivity integral for the entire borehole, the transmissivity of any given borehole interval is the difference between the values of the curve in FIG. 1 between any two given depths in the hole. Therefore, $T_1$ is the transmissivity from the curve in FIG. 1 for any borehole interval for the index i from the bottom of the borehole to the top. For the presently disclosed method, the intervals Rare the intervals uncovered serially by the incremental inversion of the liner. Therefore the equation for Q becomes:

$$Q=(T_1(BH_2-FH_1)+T_2(BH_2-FH_2))(2\pi/\ln(R))$$

For the isolated interval of open hole volume 8, any flow into the borehole must equal the flow out of the hole. Therefore the net flow Q is zero. In that case:

$$0=T_1(BH_2-FH_1)+T_2(BH_2-FH_2)$$

$T_1$ is the transmissivity of the media subtending a first borehole interval $H_1$ and $T_2$ is the transmissivity of the media subtending a second borehole interval $H_2$; $T_1$ and $T_2$ preferably are obtained from FIG. 1, the second borehole pressure head $BH_2$ is measured, and $FH_1$ was determined from the previously calculated formation head in the media subtending the first borehole interval. Therefore, the equation can be solved for $FH_2$, the formation head in the media subtending the second borehole interval $H_2$, generally corresponding in this example to the head in the second geologic layer 2:

$$FH_2=(T_1(BH_2-FH_1)+T_2BH_2)/T_2$$

The formation head $FH_3$ in the media subtending a successive third borehole interval (i.e., $H_3$) can be determined, from this logic extended, to give:

$$FH_3=(T_1(BH_3-FH_1)+T_2(BH_3-FH_2)+T_3BH_3)/T_3$$

Or, in general terms:

$$FH_i=(T_1(BH_i-FH_1)+T_2(BH_i-FH_2)+\ldots+T_iBH_i)/T_i$$

In this manner, the formation head $FH_i$ of the media subtending each new successive interval H uncovered in seriatim by incremental inversion of the liner 10 can be determined, using the method described to measure the borehole pressure and the values of the transmissivity for each interval. The transmissivity values for each interval preferably are obtained from the continuous transmissivity measured during the liner installation (eversion) in the borehole according to the methodology of U.S. Pat. No. 6,910,374. However, it is appreciated that the transmissivity of the borehole may be measured in some other manner, the presently disclosed technique can use those measurements to determine the formation heads in the intervals for which the transmissivity is known. But such other transmissivity measurements must be continuously connected, because the absence of the transmissivity for any interval violates the above series equation for solution of the formation pressure. If the transmissivity of a particular formation layer is known to be very small compared to the rest of the hole, the corresponding value of $T_i$ can be assumed to be zero, dropping that term from the series.

How far the liner 10 should be inverted to measure each interval can be an arbitrary short distance or, in order to reduce the number of measurements, the intervals may be selected on the basis of a transmissivity profile such as that of FIG. 1, as generated during the initial eversion of the liner into the particular borehole.

It is observed that the liner 10 should provide a good seal of the hole above the inverting bottom end (9, 22, 31) of the liner. Otherwise, the leakage will violate the method. It is also noted that the liner provides a much better isolation of an interval below the liner than some type of conventional borehole packer, because a packer may be bypassed by flow in the borehole, and/or in the formation, from layers far above (which would violate the measurement method).

Figure 5:
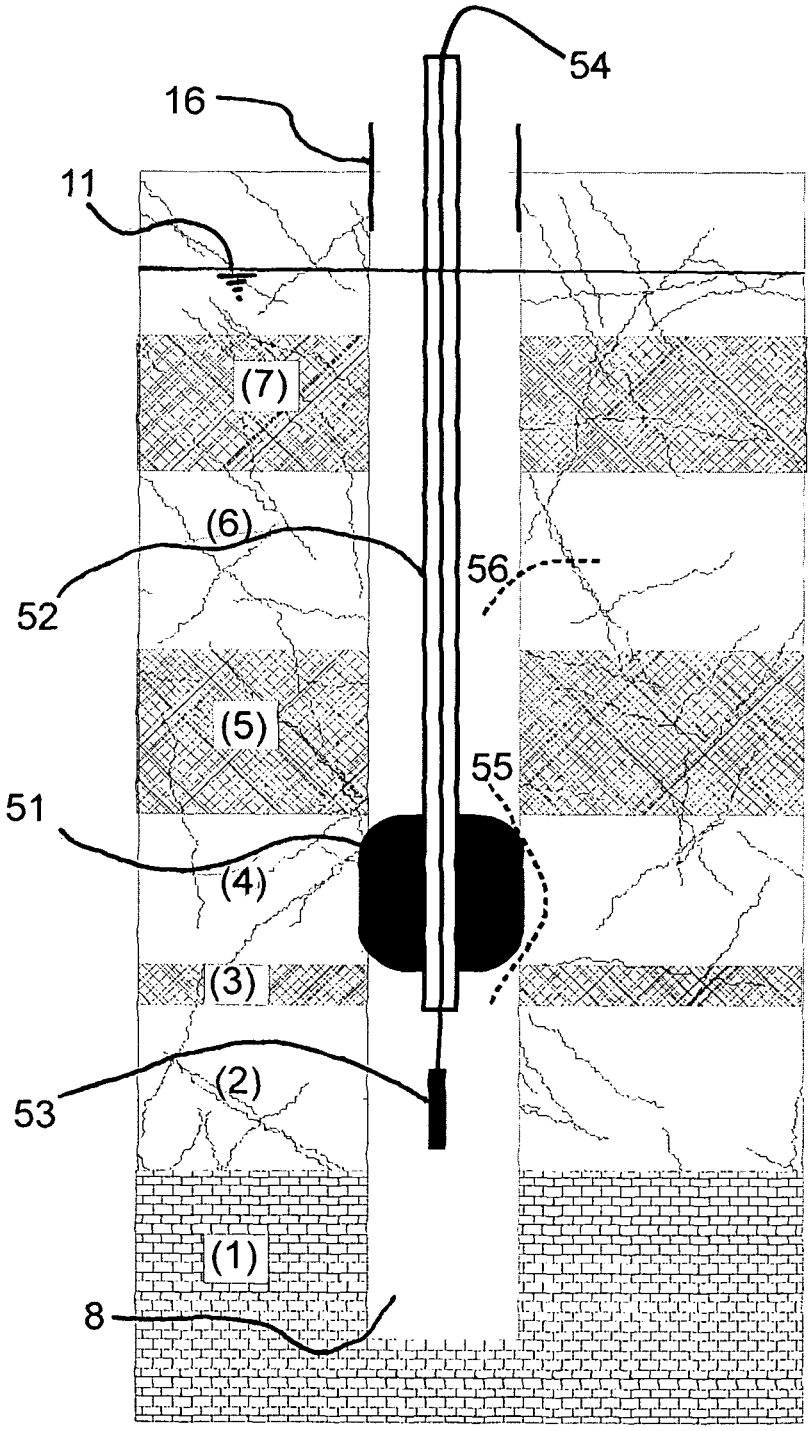
FIG. 5 is a side sectional diagram illustrating a disadvantage of using a borehole packer to attempt the same kind of measurement.

In this regard, attention is invited to FIG. 5 illustrating an alternative approach to the method. FIG. 5 shows an inflatable packer 51 supported on a pipe 52 with a transducer 53 connected via a cable to the surface 54. But it is still noteworthy that the liner 10 provides a much better isolation of the volume 8 below the liner than a borehole packer 51 as shown in FIG. 5, because such a packer may be bypassed by flow in the borehole, and/or flow 55 in the formation from geologic layers (e.g. layers 56 far above), which would violate the measurement method. The seal provided by the flexible liner 10 thus is a central feature of this measurement technique. It is noted, though, that this method can be used to assess any number of reasonable intervals, since it is not limited in what distance the liner is raised for each increment.

In some situations, the interior liner head (per water level 12) is not greater than the head everywhere in the geologic formation. For example, there may be an artesian flow zone in the lower region of the borehole. In such a case, the interior liner pressurization to a head above that anywhere in the formation can be effected by the use of a heavy fluid, heavier than water, such as Bentonite slurry with a barite additive. This heavy mud is commonly used in the drilling industry to prevent borehole collapse while drilling the borehole. In that case, the added density must be accounted for in the use of the liner head in the calculations. It is a simple multiplication of the water head measured. Another possible technique for maintaining a higher head in the liner 10 is to extend the surface casing 16 (e.g. FIG. 2) a substantial distance above the ground surface to obtain a higher head (from 12) in the liner.

Figure 6:
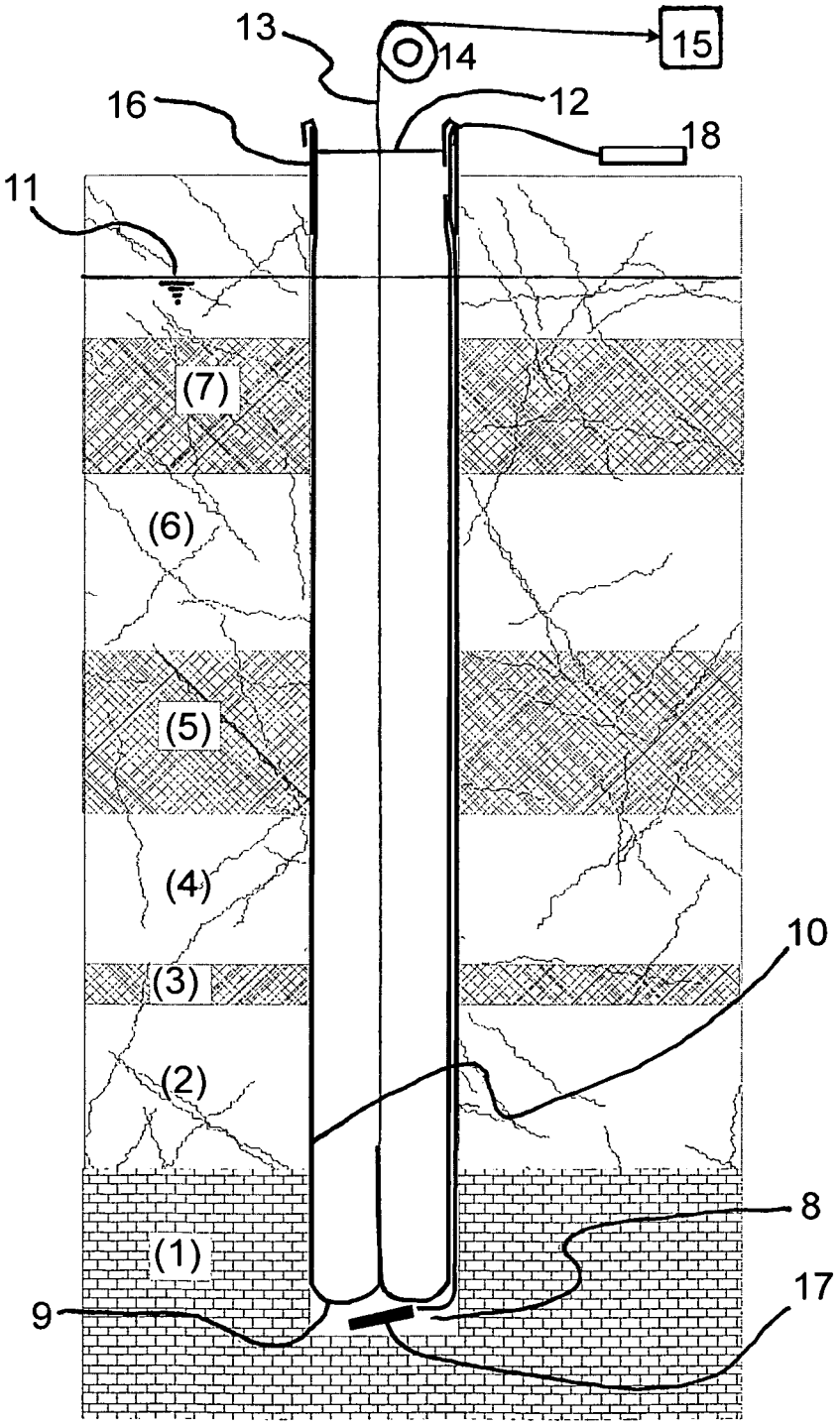
FIG. 6 is a side sectional diagram depicting the lined borehole geometry, with a recording pressure transducer situated below the liner.

Reference is made to FIG. 6. The measurement of the borehole pressure is done with the aid of a pressure transducer 17 lowered to the bottom of the borehole, in the open hole volume 8, before the everting liner 10 is used to measure the transmissivity distribution. The pressure transducer 17 is connected by a slender cable to the pressure monitor 18 on the surface. If the pressure transducer 17 is located at the bottom of the borehole as seen in FIG. 6, the borehole pressure head, BH, can be measured directly (and thus does not require the tension measurement in the liner 10 to deduce the head below the liner). The remainder of the process and analysis remains the same, and the liner seal of the borehole above the open hole volume 8 is still an important feature of the method.

The uncertainty of the measurement for any interval is related to the inverse of the transmissivity. Since low transmissivity intervals are not well measured, they can be left out of the calculation with little effect. Also, the availability of other relevant information on the geologic structure is helpful to selection of the intervals to be measured, but it is not required. The transmissivity profile obtained during liner eversion often suggests flow zones of interest.

The method of measurement of DP by summing two tensions, as described above, is also useful for determining the drag of the liner in the borehole. Subtracting $T_{ev}$ from $T_{in}$ leaves the difference $P_{min}$+Drag. The value of $P_{min}$ has been determined empirically from laboratory tests for a wide range of liner sizes and liner construction materials. The unknown drag is dependent on borehole characteristics such as size, distance to the water table, and deviation from vertical. It is useful to the method of measurement of transmissivity shown in FIG. 1 to know the value of the Drag as a function of depth in the borehole, and that value can be used to refine the calculation of transmissivity (as shown in FIG. 1).

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all patents cited above are hereby incorporated by reference.

I claim:

1. A method for profiling a hydraulic head in a geologic media around a borehole, comprising the steps of:

obtaining a transmissivity profile of the geologic media by:

everting a flexible liner down the borehole by moving a liner eversion point down the borehole to cover successively a plurality of borehole intervals;

calculating, from a downward velocity of the eversion point, the conductivity of the media subtending each borehole interval; and using the media conductivity to calculate the transmissivity of the media subtending each borehole interval;

determining a first borehole pressure head in a first open hole volume between the eversion point and a bottom of the borehole, the first borehole pressure head approximately equaling a formation pressure head in the media subtending a first borehole interval;

moving a liner inversion point up the borehole to uncover successively a second borehole interval;

determining a second borehole pressure head in a second open hole volume between the inversion point and the bottom of the borehole; and calculating a formation pressure head in the media subtending the second borehole interval using the formula $$FH_2=(T_1(BH_2-FH_1))/T_2$$

wherein $FH_2$ is the formation pressure head in the media subtending the second borehole interval, $T_1$ is the transmissivity of the media subtending the first borehole interval, $BH_2$ is the borehole pressure head in the open hole volume between the inversion point of the second borehole interval and the bottom of the borehole, $FH_1$ is the formation pressure head in the media subtending the first borehole interval, and $T_2$ is the transmissivity of the media subtending the second borehole interval.

2. The method of claim 1 wherein the steps of determining a first borehole pressure head and determining a second borehole pressure head comprise disposing and monitoring a pressure transducer in the first open hole volume and then in the second open hole volume.

3. The method of claim 1 comprising the further steps of:

moving the liner inversion point incrementally up the borehole to uncover successively other ones of the plurality of borehole intervals;

determining pressure heads in other open hole volumes between the inversion point and the bottom of the borehole; and calculating a formation pressure head in the media subtending each of the other borehole intervals using the formula $$FH_i=(T_1(BH_i-FH_1)+T_2(BH_i-FH_2)+\ldots+T_iBH_i)/T_i$$

wherein $FH_i$ is the formation pressure head in the media subtending a selected one of the other borehole intervals, $T_1$ is the transmissivity of the media subtending the first borehole interval, $T_2$ is the transmissivity of the media subtending the second borehole interval, $T_i$ is the transmissivity of the media subtending the selected one of the other borehole intervals, $FH_1$ is the formation pressure head in the media subtending the first borehole interval, $FH_2$ is the formation pressure head in the media subtending the second borehole interval, and $BH_i$ is the borehole pressure head in the open hole volume between the inversion point of the selected one of the other borehole intervals and the bottom of the borehole.

4. The method of claim 1 wherein the step of determining any borehole pressure head comprises the step of determining the borehole pressure head from a monitored liner pressure head in an interior of the liner and from a differential pressure head across the liner at an inversion point.

5. The method of claim 4 wherein the step of determining the borehole pressure head comprises the steps of:

attachably disposing a tether between a closed absolute end of the liner and a surface above the top end of the borehole;

monitoring the liner pressure head within the interior of the liner;

lifting the tether a distance, thereby inverting the liner to establish a first elevation for the inversion point of the liner;

halting the inversion of the liner;

monitoring a decrease in the tether tension until the tether tension stops decreasing and stabilizes at a first equilibrium tension value;

recording the first equilibrium tension value;

briefly lowering the tether to allow the liner to evert a distance back down the borehole to establish a second elevation for the inversion point of the liner;

halting the eversion of the liner;

monitoring an increase in the tether tension until the tether tension stops increasing and stabilizes at a second equilibrium tension value;

recording the second equilibrium tension value;

using the first and second equilibrium tension values to calculate a differential pressure across the liner at the liner inversion point; and calculating the borehole pressure head from the liner pressure head and the differential pressure.

6. A method for profiling a hydraulic head in a geologic media around a borehole, comprising the steps of:

obtaining a transmissivity of media subtending each of a plurality of borehole intervals;

everting a flexible liner down the borehole;

determining a formation pressure head in the media subtending a first borehole interval by determining a first borehole pressure head in a first open hole volume between a liner inversion point and a bottom of the borehole;

moving the liner inversion point incrementally up the borehole to uncover successively other ones of the borehole intervals;

determining pressure heads in other open hole volumes between the inversion point and the bottom of the borehole; and calculating a formation pressure head in the media subtending each of the other borehole intervals using the formula $$FH_i=(T_1(BH_i-FH_1)+\ldots+T_iBH_i)/T_i$$

wherein $FH_i$ is the formation pressure head in the media subtending a selected one of the other borehole intervals, $T_1$ is the transmissivity of the media subtending the first borehole interval, $T_i$ is the transmissivity of the media subtending the selected one of the other borehole intervals, $FH_1$ is the formation pressure head in the media subtending the first borehole interval, and $BH_i$ is the borehole pressure head in the open hole volume between the inversion point of the selected one of the other borehole intervals and the bottom of the borehole.

7. The method of claim 6 wherein the step of determining a borehole pressure head in any of the open hole volumes comprises the step of disposing and monitoring a pressure transducer in the open hole volume.

8. The method of claim 6 wherein the step of determining a borehole pressure head comprises the steps of:

attachably disposing a tether between a closed absolute end of the liner and a surface above the top end of the borehole;

monitoring a liner pressure head within the interior of the liner;

lifting the tether a distance, thereby inverting the liner to establish a first elevation for the inversion point of the liner;

halting the inversion of the liner;

monitoring a decrease in the tether tension as water flows from media subtending the first borehole interval and into the open hole volume between the inversion point and a bottom of the borehole, until the tether tension stops decreasing and stabilizes at a first equilibrium tension value;

recording the first equilibrium tension value;

briefly lowering the tether to allow the liner to evert a distance back down the borehole to establish a second elevation for the inversion point of the liner;

halting the eversion of the liner;

monitoring an increase in the tether tension as water in the open hole volume between the inversion point and a bottom of the borehole is forced from the open hole volume between the inversion point and a bottom of the borehole and back into media subtending the first borehole interval, until the tether tension stops increasing and stabilizes at a second equilibrium tension value;

recording the second equilibrium tension value;

using the first and second equilibrium tension values to calculate a differential pressure across the liner at the liner inversion point; and calculating the borehole pressure head from the liner pressure head and the differential pressure.

9. A method for profiling the hydraulic head in the geologic media around a borehole, comprising the steps of:

obtaining the transmissivity profile of the geologic media by everting a flexible liner down the borehole by moving a liner eversion point down the borehole to cover successively a plurality of borehole intervals, calculating from a velocity of the eversion point the conductivity of the media subtending each borehole interval, and using the media conductivity to calculate the transmissivity of the media subtending each borehole interval;

inverting the liner up the borehole by moving a liner inversion point incrementally up the borehole to uncover a first one of the borehole intervals;

determining a borehole pressure head in a first open hole volume between the inversion point and a bottom of the borehole; and calculating, from the borehole pressure head in the first open hole volume and from the transmissivity of the media subtending the first borehole interval, a formation pressure head in the media subtending the first borehole interval;

moving the liner inversion point incrementally up the borehole to uncover successively a second one of the borehole intervals;

determining a second borehole pressure head in a second open hole volume between the inversion point and the bottom of the borehole;

calculating, from the second borehole pressure head in the second open hole volume and from the transmissivity of the media subtending the second borehole interval, a formation pressure head in the media subtending the second borehole interval;

moving the liner eversion point incrementally up the borehole to uncover successively other ones of the plurality of borehole intervals;

determining pressure heads in other open hole volumes between the inversion point and the bottom of the borehole; and calculating a formation pressure head in the media subtending each of the other borehole intervals using the formula $$FH_i=(T_1(BH_i-FH_1)+T_2(BH_i-FH_2)+\ldots+T_iBH_i)/T_i$$

wherein $FH_i$ is the formation pressure head in the media subtending a selected one of the other borehole intervals, $T_1$ is the transmissivity of the media subtending the first borehole interval, $T_2$ is the transmissivity of the media subtending the second borehole interval, $T_i$ is the transmissivity of the media subtending the selected one of the other borehole intervals, $FH_1$ is the formation pressure head in the media subtending the first borehole interval, $FH_2$ is the formation pressure head in the media subtending the second borehole interval, and $BH_i$ is the borehole pressure head in the open hole volume between the inversion point of the selected one of the other borehole intervals and the bottom of the borehole.

* * * * *